US006669417B2

(12) United States Patent
Hsieh

(10) Patent No.: US 6,669,417 B2
(45) Date of Patent: Dec. 30, 2003

(54) POSITIONING ASSEMBLY FOR POSITIONING A CONTAINER ON A PLATFORM AND METHOD FOR MAKING THE SAME

(76) Inventor: David Hsieh, 3F, No. 2, Chin-Chung St., Taichung City (TW)

( * ) Notice: Subject to any disclaimer, the term of this patent is extended or adjusted under 35 U.S.C. 154(b) by 0 days.

(21) Appl. No.: 10/145,364

(22) Filed: May 14, 2002

(65) Prior Publication Data

US 2003/0215300 A1 Nov. 20, 2003

(51) Int. Cl.[7] ..... B60P 7/08

(52) U.S. Cl. ..... 410/85; 410/77; 410/96; 410/100

(58) Field of Search ..... 410/85, 77, 80, 410/81, 96, 100, 97; 114/75; 24/265 CD; 248/499

(56) References Cited

U.S. PATENT DOCUMENTS 1,974,686 A * 9/1934 Meyercord ..... 410/84
3,083,670 A * 4/1963 Harlander et al. ..... 410/85
3,398,922 A * 8/1968 Martin ..... 410/85
4,096,816 A * 6/1978 Patterson, III et al.
4,537,539 A * 8/1985 Borchardt ..... 410/77
4,732,516 A * 3/1988 Borchardt ..... 410/77
4,861,205 A * 8/1989 Wozniak et al. ..... 410/47
5,143,010 A * 9/1992 Behr et al.

* cited by examiner

*Primary Examiner*—Stephen T. Gordon
(74) *Attorney, Agent, or Firm*—Christie, Parker & Hale, LLP

(57) ABSTRACT

A positioning assembly includes a connecting rod, a pivot pin, and a hook member. The connecting rod has a U-shaped end with opposing first and second arm portions which cooperatively define a gap therebetween and which are respectively formed with first and second through-holes. The first arm portion is formed with a first flange that projects outwardly and that converges from a periphery of the first through-hole. The second arm portion is formed with a second flange that projects inwardly from a periphery of the second through-hole. The first and second flanges confine first and second openings, respectively. The pivot pin extends into the first and second through-holes, and has a diameter greater than dimensions of the first and second openings so as to be limited in the first and second through-holes. The hook member has a pivot end that is disposed in the gap and that is rotatably sleeved on the pivot pin.

3 Claims, 7 Drawing Sheets

POSITIONING ASSEMBLY FOR POSITIONING A CONTAINER ON A PLATFORM AND METHOD FOR MAKING THE SAME

BACKGROUND OF THE INVENTION

1. Field of the Invention

This invention relates to a positioning assembly for positioning a container on a platform of a vehicle and to a method for making the same.

2. Description of the Related Art

FIGS. 1 and 2 illustrate conventional positioning assemblies for positioning containers on a platform 11 of a vehicle, such as a cargo-carrying ship. Each of the positioning assemblies is made from a metal, and includes a connecting rod 3 with a U-shaped end 30. A hook member 33 has a hook end 331 that hooks on a retaining hole in a corner fitting 21 of a container 20, and a pivot end that is pivoted to the U-shaped end 30 of the connecting rod 3 via screw means which include a screw bolt 333 and a screw nut 336. Each of the positioning assemblies is required to be coated with a layer of anti-corrosion material, such as zinc, for preventing corrosion thereof when exposed to a sea environment. However, it would be impossible for the screw bolt 333 to threadedly engage the screw nut 336 if a threaded portion of the screw bolt 333 or a threaded portion of the screw nut 336 is coated with a layer of the anti-corrosion material. As a consequence, at least the threaded portions of the screw bolt 333 and the screw nut 336 cannot be protected from corrosion. Moreover, engagement between the screw bolt 333 and the screw nut 336 tends to loosen after a period of use.

SUMMARY OF THE INVENTION

Therefore, the object of the present invention is to provide a positioning assembly that is capable of overcoming the aforesaid drawbacks.

Another object of the present invention is to provide a method for making the positioning assembly.

According to one aspect of the present invention, there is provided a positioning assembly for positioning a container on a platform. The container has a corner fitting formed with a retaining hole. The positioning assembly comprises: a connecting rod having a U-shaped end with opposing first and second arm portions which cooperatively define a gap therebetween and which are respectively formed with first and second through-holes aligned and extending in a transverse direction relative to lengths of the first and second arm portions and in spatial communication with the gap, each of the first and second through-holes having an outer end, the left arm portion being formed with a first flange that projects outwardly and that converges from a periphery of the outer end of the first through-hole in a direction away from the gap, the right arm portion being formed with a second flange that projects inwardly from a periphery of the outer end of the second through-hole, the first and second flanges confining first and second openings, respectively; a pivot pin extending through the gap and into the first and second through-holes, and having a diameter greater than dimensions of the first and second openings so as to be limited in the gap and the first and second through-holes; and a hook member having a pivot end that is disposed in the gap and that is rotatably sleeved on the pivot pin, and a hook end that is opposite to the pivot end, that extends outwardly of the gap, and that is adapted to hook on the retaining hole in the corner fitting of the container.

According to another aspect of the present invention, there is provided a method for making a positioning assembly for positioning a container on a platform. The method comprises the steps of: (a) preparing a pivot pin, a hook member, and a connecting rod having a U-shaped end with opposing first and second arm portions which cooperatively define a gap therebetween and which are respectively formed with first and second through-holes aligned and extending in a transverse direction relative to lengths of the first and second arm portions and in spatial communication with the gap, each of the first and second through-holes having an outer end, the left arm portion being formed with a first flange that projects outwardly from a periphery of the outer end of the first through-hole in a direction away from the gap, the right arm portion being formed with a second flange that projects inwardly from a periphery of the outer end of the second through-hole, the first and second flanges confining first and second openings, respectively, the hook member having a pivot end formed with a pivot hole, and a hook end opposite to the pivot end, the pivot pin having a diameter less than a dimension of the first opening and greater than a dimension of the second opening; (b) coating each of the connecting rod, the pivot pin, and the hook member with a layer of an anti-corrosion material; (c) assembling the connecting rod, the hook member and the pivot pin by disposing the pivot end of the hook member in the gap in such a manner that the pivot hole is aligned with the first and second through-holes in the transverse direction and by inserting the pivot pin into the first through-hole, the gap, the pivot hole, and the second through-hole via the first opening in such a manner that the pivot pin is disposed between the outer ends of the first and second through-holes; and (d) punching the first flange after the step (c) to reduce the dimension of the first opening so as to prevent removal of the pivot pin from the U-shaped end of the connecting rod.

BRIEF DESCRIPTION OF THE DRAWINGS

In drawings which illustrate an embodiment of the invention.

DETAILED DESCRIPTION OF THE PREFERRED EMBODIMENT

Figure 1:
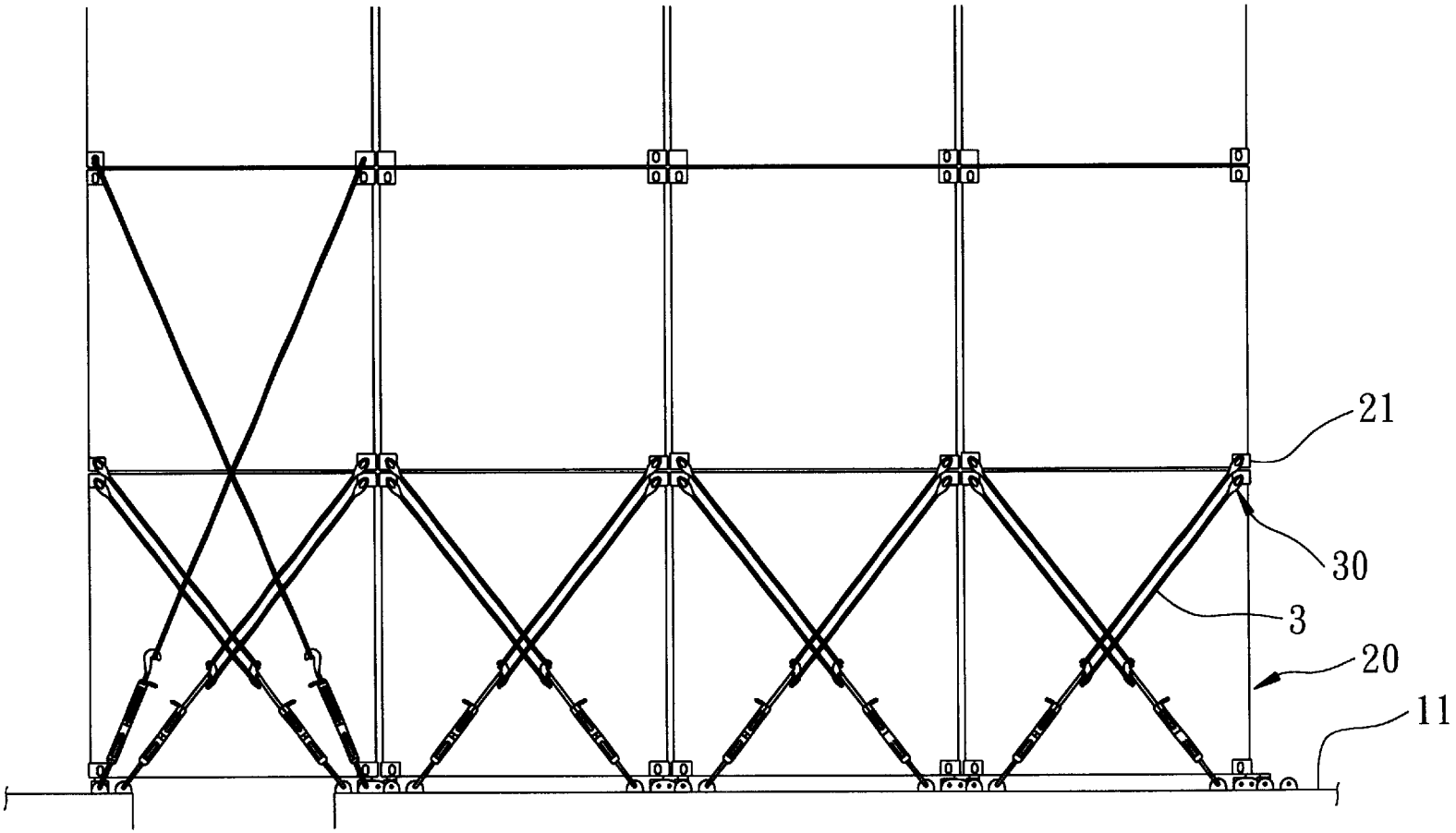
FIG. 1 PRIOR ART
FIG. 1 is a schematic side view to illustrate how conventional positioning assemblies are connected to corner fittings of containers on a platform.
Figure 2:
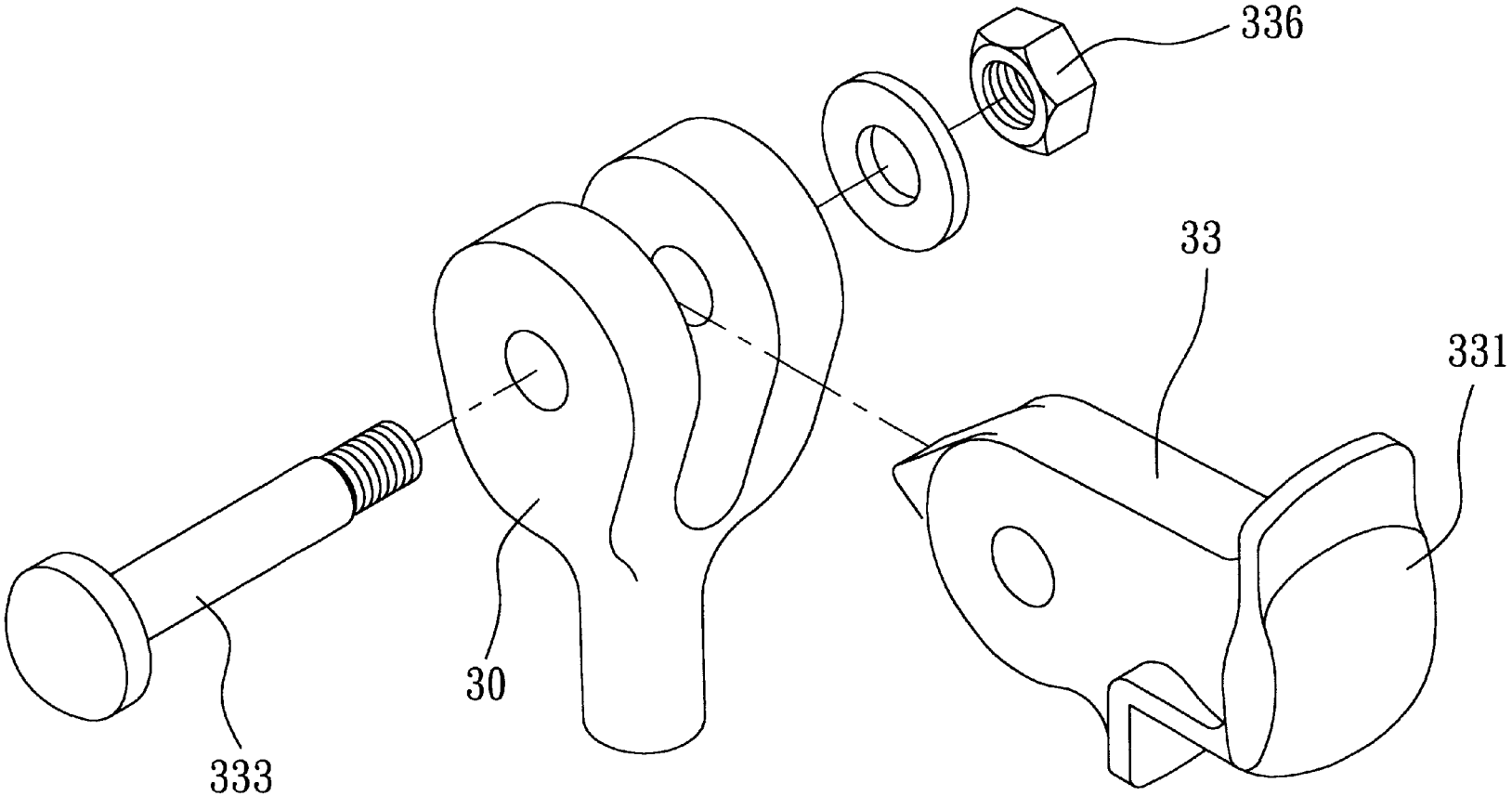
FIG. 2 PRIOR ART
FIG. 2 is an exploded perspective view of one of the positioning assemblies of FIG. 1.
Figure 3:
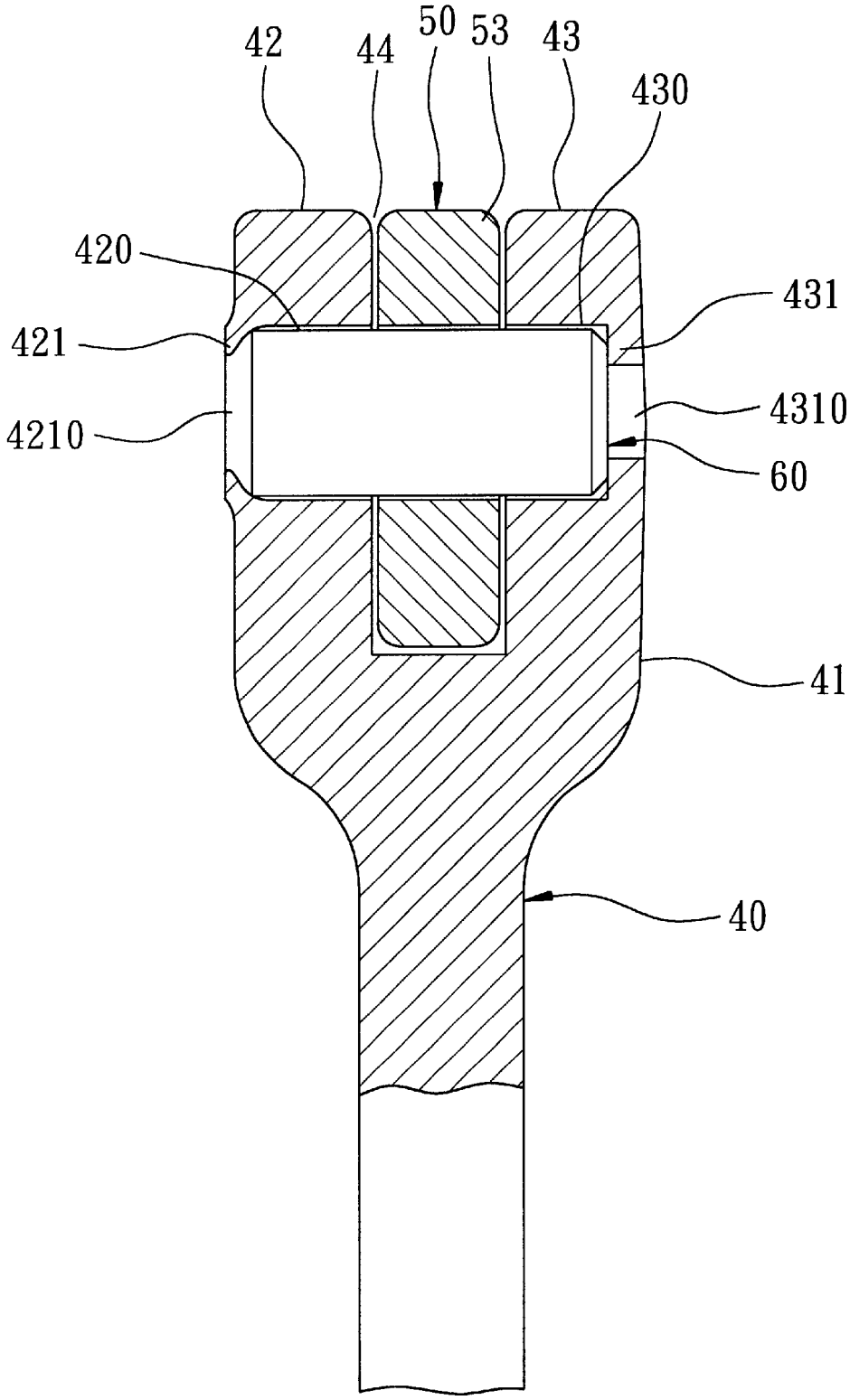
FIG. 3 is a sectional view of a preferred embodiment of a positioning assembly of this invention.
Figure 4:
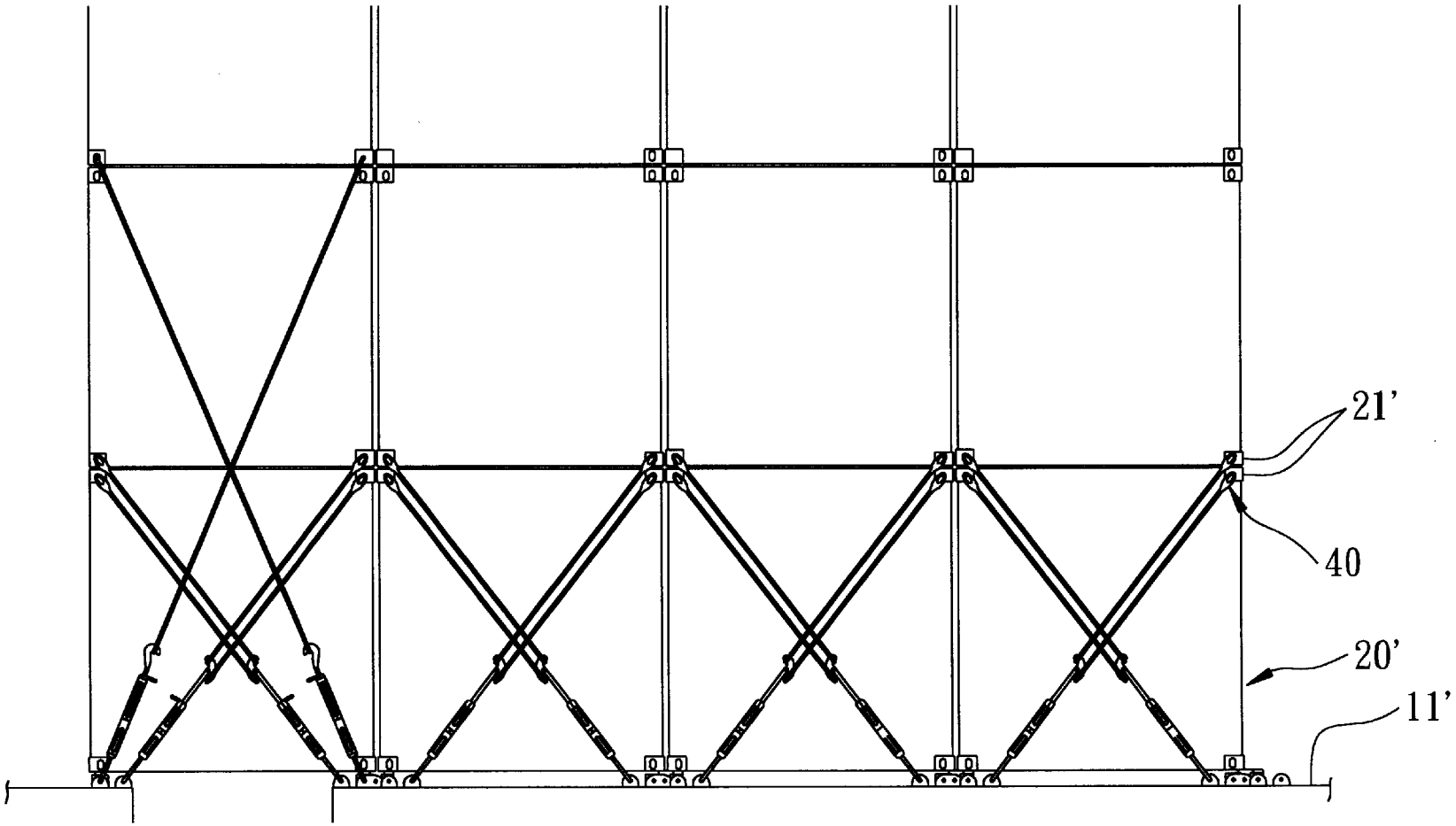
FIG. 4 is a schematic side view to illustrate how the positioning assembly of FIG. 3 is connected to a container on a platform.

FIGS. 3 and 4 illustrate the preferred embodiment of the positioning assembly of this invention for positioning a container 20' on a platform 11' of a vehicle, such as a cargo-carrying ship (not shown). The container 20' has a corner fitting 21' that is formed with a retaining hole.

The positioning assembly includes: a connecting rod 40 having a U-shaped end 41 with opposing first and second arm portions 42, 43 which cooperatively define a gap 44 therebetween and which are respectively formed with first and second through-holes 420, 430 aligned and extending in a transverse direction relative to lengths of the first and second arm portions 42, 43 and in spatial communication with the gap 44, each of the first and second through-holes 420, 430 having an outer end, the left arm portion 42 being formed with a first flange 421 that projects outwardly and that converges from a periphery of the outer end of the first through-hole 420 in a direction away from the gap 44, the right arm portion 43 being formed with a second flange 431 that projects inwardly from a periphery of the outer end of the second through-hole 430, the first and second flanges 421, 431 confining first and second openings 4210, 4310, respectively; a pivot pin 60 extending through the gap 44 and into the first and second through-holes 420, 430, and having a diameter greater than the dimensions of the first and second openings 4210, 4310 so as to be limited in the gap 44 and the first and second through-holes 420, 430; and a hook member 50 having a pivot end 53 that is disposed in the gap 44 and that is rotatably sleeved on the pivot pin 60 via extension of the pivot pin 60 through a pivot hole 51 in the pivot end 53, and a hook end 52 (see FIG. 5) that is opposite to the pivot end 53, that extends outwardly of the gap 44, and that is adapted to hook on the retaining hole in the corner fitting 21' of the container 20'.

Figure 5:
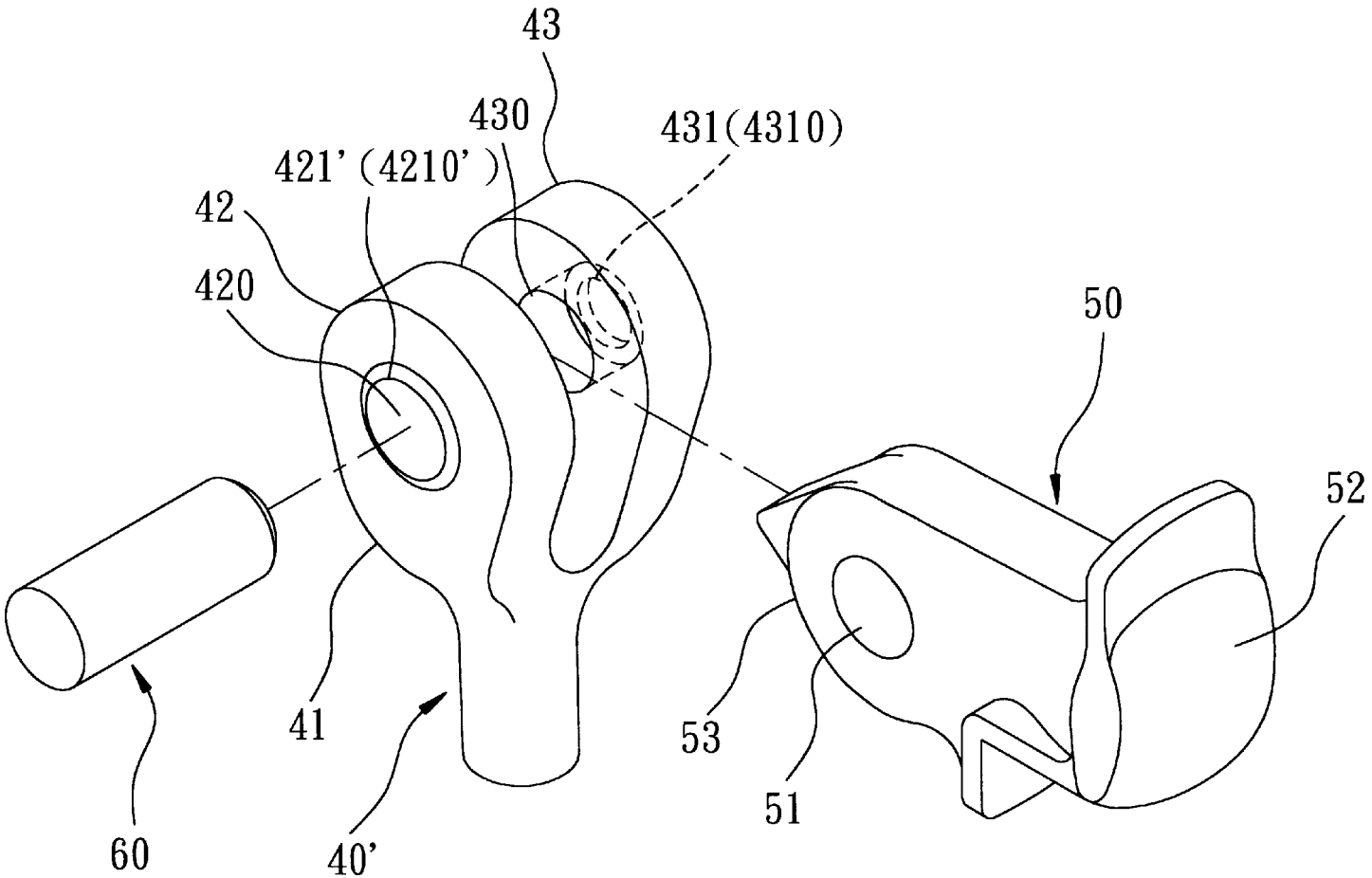
FIG. 5 is an exploded perspective view to illustrate a preparation step for making the positioning assembly according to a method that embodies this invention.
Figure 6:
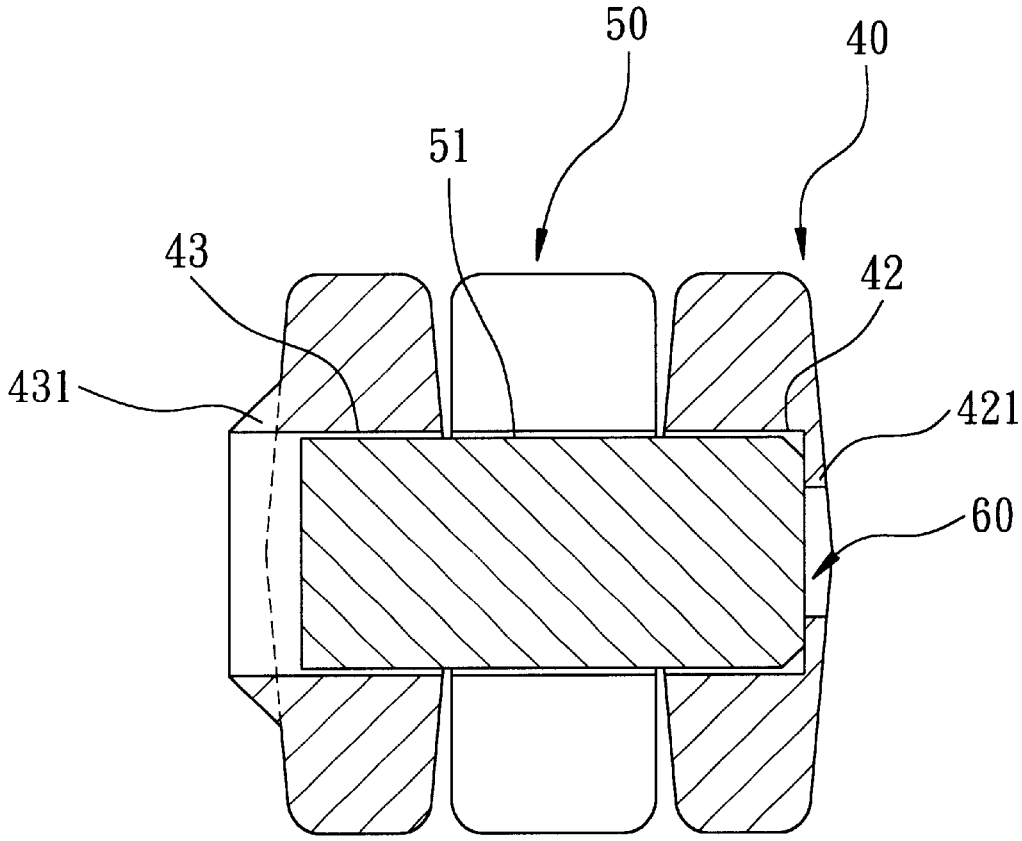
FIG. 6 is a sectional view to illustrate an assembling step for making the positioning assembly according to the method of this invention.
Figure 7:
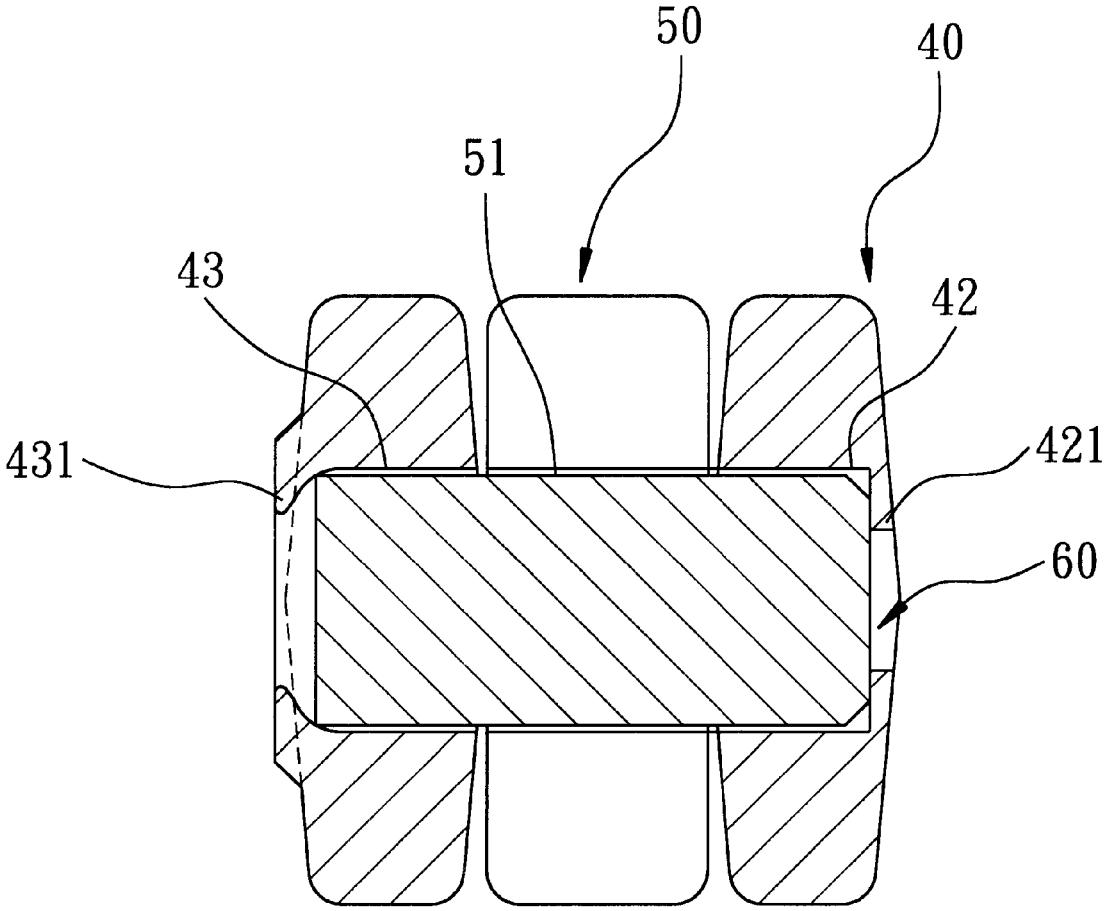
FIG. 7 is a sectional view to illustrate a punching step for making the positioning assembly according to the method of this invention.

FIGS. 5 to 7 illustrate consecutive steps of making the positioning assembly of FIG. 3 by the method of this invention. The method includes the steps of: (a) preparing the pivot pin 60, the hook member 50, and a connecting rod 40', each of the connecting rod 40', the hook member 50, and the pivot pin 60 being made from a metal, the connecting rod 40' having a structure similar to that of the connecting rod 40 shown in FIG. 3, except that the first flange 421' projects outwardly from the periphery of the outer end of the first through-hole 420 in such a manner that the diameter of the pivot pin 60 is less than the dimension of the first opening 4210'; (b) coating each of the connecting rod 40', the pivot pin 60, and the hook member 50 with a layer of an anti-corrosion material which is made from zinc; (c) assembling the connecting rod 40'', the hook member 50, and the pivot pin 60 by disposing the pivot end 53 of the hook member 50 in the gap 44 in such a manner that the pivot hole 51 is aligned with the first and second through-holes 420, 430 in the transverse direction and by inserting the pivot pin 60 into the first through-hole 420, the gap 44, the pivot hole 51, and the second through-hole 430 via the first opening 4210' in such a manner that the pivot pin 60 is disposed between the outer ends of the first and second through-holes 420, 430; and (d) punching the first flange 421' after the step (c) to reduce the dimension of the first opening 4210' so as to form the punched first flange 421 shown in FIG. 3 and so as to prevent removal of the pivot pin 60 from the U-shaped end 41 of the connecting rod 40'.

Since the entire positioning assembly of this invention can be coated with the anti-corrosion material, the drawbacks as encountered in the prior art can be eliminated.

With the invention thus explained, it is apparent that various modifications and variations can be made without departing from the spirit of the present invention. It is therefore intended that the invention be limited only as recited in the appended claims.

I claim:

1. A positioning assembly for positioning a container on a platform, the container having a corner fitting formed with a retaining hole, said positioning assembly comprising:

a connecting rod having a U-shaped end with opposing first and second arm portions which cooperatively define a gap therebetween and which are respectively formed with first and second through-holes aligned and extending in a transverse direction relative to lengths of said first and second arm portions and in spatial communication with said gap, each of said first and second through-holes having an outer end, said first arm portion being formed with a first flange that projects outwardly and that converges from a periphery of said outer end of said first through-hole in a direction away from said gap, said second arm portion being formed with a second flange that projects inwardly from a periphery of said outer end of said second through-hole, said first and second flanges confining first and second openings, respectively;

a pivot pin extending through said gap and into said first and second through-holes, and having a diameter greater than dimensions of said first and second openings so as to be limited in said gap and said first and second through-holes; and a hook member having a pivot end that is disposed in said gap and that is rotatably sleeved on said pivot pin, and a hook end that is opposite to said pivot end, that extends outwardly of said gap, and that is adapted to hook on the retaining hole in the corner fitting of the container.

2. The positioning assembly of claim 1, wherein each of said connecting rod, said pivot pin, and said hook member is made from a metal, and is coated with a layer of an anti-corrosion material.

3. A method for making a positioning assembly for positioning a container on a platform, said method comprising the steps of:

(a) preparing a pivot pin, a hook member, and a connecting rod having a U-shaped end with opposing first and second arm portions which cooperatively define a gap therebetween and which are respectively formed with first and second through-holes aligned and extending in a transverse direction relative to lengths of said first and second arm portions and in spatial communication with said gap, each of said first and second through-holes having an outer end, said first arm portion being formed with a first flange that projects outwardly from a periphery of said outer end of said first through-hole in a direction away from said gap, said second arm portion being formed with a second flange that projects inwardly from a periphery of said outer end of said second through-hole, said first and second flanges confining first and second openings, respectively, said hook member having a pivot end formed with a pivot hole, and a hook end opposite to said pivot end, said pivot pin having a diameter less than a dimension of said first opening and greater than a dimension of said second opening;

(b) coating each of said connecting rod, said pivot pin, and said hook member with a layer of an anti-corrosion material;

(c) assembling said connecting rod, said hook member, and said pivot pin by disposing said pivot end of said hook member in said gap in such a manner that said pivot hole is aligned with said first and second through-holes in the transverse direction and by inserting said pivot pin into said first through-hole, said gap, said pivot hole, and said second through-hole via said first opening in such a manner that said pivot pin is disposed between said outer ends of said first and second through-holes; and (d) punching said first flange after the step (c) to reduce the dimension of said first opening so as to prevent removal of said pivot pin from said U-shaped end of said connecting rod.

* * * * *